US008008245B2

(12) United States Patent
Panandiker et al.

(10) Patent No.: US 8,008,245 B2
(45) Date of Patent: Aug. 30, 2011

(54) FABRIC CARE COMPOSITIONS AND SYSTEMS COMPRISING ORGANOSILICONE MICROEMULSIONS AND METHODS EMPLOYING SAME

(75) Inventors: Rajan Keshav Panandiker, West Chester, OH (US); Kerry Andrew Vetter, Cincinnati, OH (US); Freddy Arthur Barnabas, West Chester, OH (US); Patrick Firmin August Delplancke, Laaren (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/560,639

(22) Filed: Sep. 16, 2009

(65) Prior Publication Data

US 2010/0011512 A1 Jan. 21, 2010

Related U.S. Application Data

(62) Division of application No. 11/584,972, filed on Oct. 23, 2006, now Pat. No. 7,608,575.

(60) Provisional application No. 60/729,622, filed on Oct. 24, 2005.

(51) Int. Cl.
*C11D 9/36* (2006.01)
*C11D 1/75* (2006.01)

(52) U.S. Cl. ..... 510/417; 510/276; 510/307; 510/324; 510/343; 510/347; 510/351; 510/394; 510/466; 510/332; 510/333

(58) Field of Classification Search ..... 510/417, 510/276, 307, 324, 343, 347, 351, 394, 466, 510/332, 333
See application file for complete search history.

(56) References Cited

U.S. PATENT DOCUMENTS

| | | | | |
|---|---|---|---|---|
| 4,483,779 | A | 11/1984 | Llenado et al. | |
| 4,483,780 | A | 11/1984 | Llenado | |
| 4,565,647 | A | 1/1986 | Llenado | |
| 5,173,201 | A | 12/1992 | Coffindaffer et al. | |
| 5,188,769 | A | 2/1993 | Connor et al. | |
| 5,332,528 | A | 7/1994 | Pan et al. | |
| 5,445,747 | A | 8/1995 | Kvietok et al. | |
| 5,458,809 | A | 10/1995 | Fredj et al. | |
| 5,500,138 | A | 3/1996 | Bacon et al. | |
| 5,531,910 | A | 7/1996 | Severns et al. | |
| 5,532,023 | A | 7/1996 | Vogel et al. | |
| 5,549,840 | A | 8/1996 | Mondin et al. | |
| 5,576,282 | A | 11/1996 | Miracle et al. | |
| 5,585,343 | A | 12/1996 | McGee et al. | |
| 5,597,936 | A | 1/1997 | Perkins et al. | |
| 5,620,952 | A | 4/1997 | Fu et al. | |
| 5,646,101 | A | 7/1997 | MacBeath | |
| 5,661,215 | A | 8/1997 | Gee et al. | |
| 5,686,014 | A | 11/1997 | Baillely et al. | |
| 5,695,679 | A | 12/1997 | Christie et al. | |
| 5,698,504 | A | 12/1997 | Christie et al. | |
| 5,705,464 | A | 1/1998 | Scheper et al. | |
| 5,710,115 | A | 1/1998 | Patel et al. | |
| 5,712,343 | A | 1/1998 | Geck et al. | |
| 5,741,760 | A | 4/1998 | Mondin et al. | |
| 5,759,208 | A | 6/1998 | Zhen et al. | |
| 5,759,983 | A | 6/1998 | Mondin et al. | |
| 5,817,614 | A | 10/1998 | Miracle et al. | |
| 5,997,886 | A * | 12/1999 | Peffly et al. | 424/401 |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,071,867 | A | 6/2000 | Purcell et al. | |
| 6,080,708 | A | 6/2000 | Glenn, Jr. et al. | |
| 6,093,410 | A | 7/2000 | Peffly et al. | |
| 6,093,856 | A | 7/2000 | Cripe et al. | |
| 6,111,056 | A | 8/2000 | Hildebrandt et al. | |
| 6,149,898 | A | 11/2000 | Peffly et al. | |
| 6,150,322 | A | 11/2000 | Singleton et al. | |
| 6,153,569 | A * | 11/2000 | Halloran | 510/119 |
| 6,153,577 | A | 11/2000 | Cripe et al. | |
| 6,191,090 | B1 | 2/2001 | Mondin et al. | |
| 6,225,464 | B1 | 5/2001 | Hiler, II et al. | |
| 6,251,246 | B1 | 6/2001 | Chan | |
| 6,274,540 | B1 | 8/2001 | Scheibel et al. | |
| 6,306,812 | B1 | 10/2001 | Perkins et al. | |
| 6,306,817 | B1 | 10/2001 | Kott et al. | |
| 6,326,348 | B1 | 12/2001 | Vinson et al. | |
| 6,369,024 | B1 | 4/2002 | Panandiker et al. | |
| 6,410,493 | B1 | 6/2002 | Garnier | |
| 6,482,787 | B1 | 11/2002 | Panandiker et al. | |
| 6,482,994 | B2 | 11/2002 | Scheper et al. | |
| 6,491,840 | B1 | 12/2002 | Frankenbach et al. | |
| 6,514,926 | B1 | 2/2003 | Kott et al. | |
| 6,525,233 | B1 | 2/2003 | Connor et al. | |
| 6,566,319 | B1 | 5/2003 | Scheibel et al. | |
| 6,583,096 | B1 | 6/2003 | Kott et al. | |
| 6,593,285 | B1 | 7/2003 | Scheibel et al. | |
| 6,602,840 | B1 | 8/2003 | Scheibel et al. | |
| 6,733,538 | B1 | 5/2004 | Panandiker et al. | |
| 6,823,828 | B2 | 11/2004 | Nishi et al. | |
| 6,844,309 | B1 | 1/2005 | Sivik et al. | |

(Continued)

FOREIGN PATENT DOCUMENTS

| | | | |
|---|---|---|---|
| WO | WO 92/06154 | A1 | 4/1992 |
| WO | WO 92/06162 | A1 | 4/1992 |
| WO | WO 99/05084 | A1 | 2/1999 |
| WO | WO 03/000207 | A2 | 1/2003 |

OTHER PUBLICATIONS

International Search Report, International Application No. PCT/IB2006/053821, date of mailing Mar. 8, 2007, 4 pages.

*Primary Examiner* — Charles I Boyer

(74) *Attorney, Agent, or Firm* — Melissa G Krasovec; Julie A McConihay; Leonard W Lewis

(57) ABSTRACT

Systems, compositions and methods for fabric laundering comprising selected organosilicones which are formulated into microemulsions for improved deposition onto fabrics to provide fabric care benefits.

14 Claims, No Drawings

U.S. PATENT DOCUMENTS

| | | | | |
|---|---|---|---|---|
| 6,903,061 | B2 | 6/2005 | Masschelein et al. | |
| 6,908,962 | B1 | 6/2005 | Frankenbach et al. | |
| 7,306,369 | B2 | 12/2007 | Curry et al. | |
| 7,319,120 | B2 | 1/2008 | Herzig et al. | |
| 7,608,575 | B2 | 10/2009 | Panandiker et al. | |
| 2002/0173439 | A1 | 11/2002 | Murphy | |
| 2004/0157754 | A1 | 8/2004 | Geary et al. | |
| 2004/0220072 | A1* | 11/2004 | Trinh et al. | 510/475 |
| 2005/0060811 | A1 | 3/2005 | Smith et al. | |
| 2005/0089536 | A1* | 4/2005 | Loffler et al. | 424/401 |
| 2005/0098759 | A1* | 5/2005 | Frankenbach et al. | 252/8.91 |
| 2005/0129643 | A1 | 6/2005 | Lepilleur et al. | |
| 2005/0164896 | A1 | 7/2005 | Dabkowski et al. | |
| 2006/0292100 | A1 | 12/2006 | Nguyen et al. | |
| 2007/0093409 | A1 | 4/2007 | Panandiker et al. | |
| 2007/0225198 | A1 | 9/2007 | Panandiker et al. | |
| 2007/0241306 | A1 | 10/2007 | Wehner et al. | |
| 2008/0139432 | A1* | 6/2008 | Peffly et al. | 510/122 |
| 2008/0207773 | A1 | 8/2008 | Loffler et al. | |

* cited by examiner

FABRIC CARE COMPOSITIONS AND SYSTEMS COMPRISING ORGANOSILICONE MICROEMULSIONS AND METHODS EMPLOYING SAME

CROSS-REFERENCE

This application is a Divisional of U.S. application Ser. No. 11/584,972, filed Oct. 23, 2006; now U.S. Pat. No. 7,608,575 which claims the benefit of U.S. Provisional Application Ser. No. 60/729,622, filed Oct. 24, 2005.

FIELD OF THE INVENTION

This invention relates to systems, compositions and methods for fabric laundering comprising selected organosilicones which are formulated into microemulsions for improved deposition onto fabrics to provide fabric care benefits.

BACKGROUND OF THE INVENTION

In the modern world, with the increase of hustle and bustle and travel, there is a demand for reducing the time and labor involved in laundering and/or fabric care chores. That is, consumers desire a product that delivers not only excellence in cleaning, but also superior fabric care or garment care benefits, such as superior garment appearance; excellent tactile characteristics, such as fabric feel; fabric softness; reduction, removal or prevention of creases or wrinkles in garments; superior ease of ironing; garment shape retention and/or shape recovery; and fabric elasticity.

The use of organosilicones to reduce wrinkles and/or soften the fabrics has been known for some time. More recently, organosilicone in the form of aqueous emulsions have been employed in laundry and/or fabric care compositions. More specifically, organosilicone microemulsions with average particles sizes in the range of about 0.1 microns or less are believed to be more advantageous over conventional macroemulsions in at least the following aspects: (1) the microemulsions are more stable; (2) the microemulsions require less energy to make and (3) the microemulsions are translucent and/or transparent, thus, when incorporated into a liquid formulation, the resulting product has more pleasing, clear appearance. Organosilicone microemulsions in laundry or fabric care applications have been disclosed in U.S. Pat. Nos. 5,173,201; 5,532,023; 6,491,840 and references cited therein. These microemulsions are produced by the conventional process of emulsifying an organosilicone in water with surfactants. However, a large amount of surfactant is required to prepare these microemulsions. A typical concentration of silicone in a microemulsion is 10-30%. The use of a high level of surfactant increases the cost of the microemulsion. Alternatively, a low concentration of silicone in the microemulsion adds to the cost of transportation, storage, etc.

In spite of the advances in the art, there remains a need for improved fabric care using organosilicones. In one aspect, it is desirable to improve the deposition of organosilicones onto the fabrics during the aqueous laundering/cleaning process; that is, the conflict between the cleaning operation which removes substances from the fabrics and the fabric care operation which requires deposition of care actives (such as organosilicones) onto the fabrics needs to be resolved. In another aspect, it is desirable to have a process wherein silicone fluids are incorporated directly into liquid laundry compositions and form microemulsions in situ in the liquid laundry composition. This improved process would avoid using unnecessarily large amount of surfactant in the production of the microemulsion and the cost of storage and transportation. In another aspect, it is desirable to have a laundry detergent composition which combines laundry adjuncts and selected organosilicones in such a way as to achieve superior fabric cleaning and fabric care at the same time. It is further desirable that such laundry detergent exhibits formulation stability and/or a clear, or translucent appearance, all of which contribute to an aesthetically pleasing product.

SUMMARY OF THE INVENTION

The present invention solves the above-identified technical problems via the selection of specific organosilicones, identified in detail hereinafter. The selected organosilicones are suitable for preparing microemulsions and have the potential to deliver superior fabric care in fabric laundering. Moreover, given proper attention both to the selection of the organosilicones and to the formulation adjuncts, unexpectedly good fabric care and/or consumer acceptance of the home laundry product can be obtained.

In one aspect, the present invention provides: A liquid detergent composition for fabric cleaning and fabric care comprising:

(a) an organosilicone;

(b) an emulsifier comprising anionic surfactant;

(c) other laundry adjunct materials; and (d) a carrier comprising water;

wherein the organosilicone is in the form of aqueous microemulsion having an average particle size less than about 100 nm; the detergent composition has a viscosity of from about 1 to about 2000 mpa*s; and the organosilicone has a HLB value of about 2 to about 7.

The present invention has numerous advantages, including, according to the specific embodiment, one or more aspects of superior fabric care or garment care as exemplified by one or more of: superior garment appearance; excellent tactile characteristics, superior fabric feel; fabric softness; reduction, removal or prevention of creases or wrinkles in garments; superior ease of ironing; garment shape retention and/or shape recovery; and fabric elasticity. The invention has further advantages, depending on the precise embodiment, which include superior formulation flexibility and/or formulation stability of the laundry compositions provided.

The present invention delivers unexpectedly enhanced deposition of organosilicones which previously were lost in the wash liquor. Moreover, superior fabric care or garment benefits may be secured when the products herein are used in steps of the fabric laundering process, such as pre-treatment before washing in an automatic washing machine (pretreeatment benefits), through-the wash benefits, through the rinse benefits and post-treatment benefits.

The objects, features and advantages of the invention are further borne out in the following detailed description, examples and appended claims.

All percentages, ratios and proportions herein are on a weight basis of undiluted composition, unless otherwise specified.

DETAILED DESCRIPTION OF THE INVENTION

Definitions

The term "adjunct", as used herein, refers to any liquid, solid or gaseous material selected for use with the alkoxylated organosilicone polymers in the present compositions. Adjuncts are preferably, but not necessarily, inherently compatible with the alkoxylated organosilicone polymer and with other ingredients present in compositions of the present invention. When adjuncts are not inherently compatible, they may be included through various techniques such as changing the order of addition in making processes, through encapsulation, through the use of multi-part compositions to be mixed at the point of use, and the like.

The term "treated substrate," as used herein means a substrate, especially a fabric or garment, having one or more of the fabric care benefits described herein as imparted thereto by a composition comprising the selected organosilicones of the invention.

The term "fabric care composition" as used herein, refers to compositions that provide cleaning as well as fabric care benefits.

As used herein, "effective amount" of a material or composition is the amount needed to accomplish an intended purpose, for example, to impart a desired level of fabric care benefit to a fabric article/substrate.

Fabric Care Compositions

As used herein, "fabric care compositions" include fabric care compositions for handwash, machine wash and other purposes including fabric care additive compositions and compositions suitable for use in the soaking and/or pretreatment of stained fabrics. Fabric care compositions of the present invention are typically in the liquid form, preferably in an aqueous carrier. Encapsulated and/or unitized dose compositions are included, as are compositions which form two or more separate but combinedly dispensable portions.

Fabric care compositions of the present invention comprises organosilicone microemulsions and other laundry adjuncts in a suitable carrier comprising water. The fabric care compositions of the present invention have a viscosity from about 1 to about 2000 centipoise (1-2000 mPa*s), or from about 200 to about 800 centipoises (200-800 mPa*s). The viscosity can be determined by conventional methods, e.g., a TA Instruments AR1000 cone and plate viscometer, using manufacturer-suggested operating conditions at about 20-25° C.

The invention includes a composition comprising selected organosilicone polymers in the form of microemulsions. One or more of the following properties of the organosilicones are conducive to formation of microemulsions in an aqueous laundry product: chemical structure, HLB value, viscosity, molecular weight and the like. The selected organosilicones preferably are water insoluble or have limited water solubility. Suitable organosilicones are described below.

The fabric care compositions of the present invention typically comprise from about 0.01 to about 10% by weight of the composition of the organosilicones, preferably from about 0.5 to about 5%, and more preferably from about 1 to about 3%.

The composition of the present invention further comprises emulsifiers to assist and/or stabilize the microemulsification of the selected organosilicones in the carrier comprising water and optionally organic solvents, such as alcohol, e.g., ethanol.

Microemulsions are more stable than conventional macroemulsions and when incorporated into a product, the resulting product has a preferred clear appearance. More importantly, when the composition is used in a typical aqueous wash environment, the emulsifiers in the composition become diluted such that the microemulsions can no longer be maintained and the organosilicones coalesce to form significantly larger droplets which have an average particle size of greater than about 1 micron. Since the selected organosilicones are water insoluble or have limited solubility in water, they will phase-separate, "crash" out of the wash liquor, resulting in more efficient deposition onto the fabrics and enhanced fabric care benefits. In a typical immersive wash environment, the composition is mixed with an excess of water to form a wash liquor, which typically has a weight ratio of water:composition ranging from 10:1 to 400:1.

A typical embodiment of the invention may include a composition comprising from about 0.01% to about 10%, by weight of composition of the organosilicones and an effective amount of an emulsifier in a solvent system comprising water and optionally one or more organic solvents. In addition, the composition can contain at least about 0.01%, preferably at least about 1%, by weight of the composition, of one or more laundry adjunct materials such as perfume, fabric softener, enzyme, bleach, bleach activator, coupling agent, or combinations thereof. The "effective amount" of emulsifier is the amount sufficient to produce an organosilicone microemulsion in the solvent system, preferably water. In some embodiments, the amount of emulsifiers ranges from about 5 to about 75 parts, or from about 25 to about 60 parts per 100 weight parts organosilicone.

In another embodiment of the invention includes a composition having at least about 0.01% preferably from about 0.01% to about 10% by weight of the organosilicone, an effective amount of an emulsifier and in addition each of: a crystalline, hydroxyl-containing stabilizing agent; a nitrogen-free nonionic detersive surfactant; a fixing agent for anionic dyes; a solvent system comprising water and an organic solvent. This composition can further include anionic surfactants and/or other laundry adjuncts.

The fabric care compositions of the present invention may comprise effective amounts of laundry adjuncts. Unless specified hereinbelow, an "effective amount" of a particular laundry adjunct is preferably from about 0.01%, more preferably from about 0.1%, even more preferably from about 1% to about 20%, more preferably to about 15%, even more preferably to about 10%, still even more preferably to about 7%, most preferably to about 5% by weight of the fabric care compositions.

The balance of the fabric care compositions of the present invention comprises a carrier, which comprises water. In some embodiments, water is from about 85 to about 100 wt % of the carrier.

Organosilicone Microemulsions

Organosilicone compounds and emulsions of organosilicone compounds may impart lubricity and smoothness to fibers that allow them to slip or glide easily past one another and therefore enhances the process of wrinkle release or wrinkle control. Organosilicones may also provide a multitude of other fabric care benefits, including the following: fabric wear reduction; fabric pill prevention and/or reduction; and/or fabric color maintenance and/or fading reduction.

Organosilicones may also provide a variety of formulation benefits such as surface tension control and sudsing control.

The compositions of the present invention contain an organosilicone microemulsion comprising organosilicone particles dispersed in a suitable carrier (typically water) in the presence of an emulsifier (typically an anionic surfactant).

The organosilicone microemulsions typically have an average particle size less than about 100 nanometers (nm), preferably less than about 50 nm. Microemulsions having particle size in this range typically provide a clear or transparent apprearnce in the resulting compositions. In other typical embodiments, the organosilicone microemulsions have average particle sizes ranging from about 1 nm to about 500 nm, or from about 10 nm to about 100 nm, or from about 20 nm to about 50 nm. The particle size of the microemulsions can be determined by conventional methods, such as using a Leeds & Northrup Microtrac UPA particle sizer.

The microemulsion typically comprises from about 10 to about 70%, or from about 25 to about 60%, by weight of the microemulsion of the dispersed organosilicones; from about 0.1 to about 30%, or from about 1 to about 20%, by weight of the microemulsion of anionic surfactant; optionally, from about 0 to about 3%, or from about 0.1 to about 20%, by weight of the microemulsion of nonionic surfactant; and the balance being water, and optionally other carriers.

(i) Organosilicones

The organosilicones suitable for use in the present invention have the following general formula:

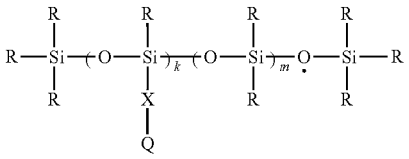

wherein each R is a $C_1$-$C_8$ alkyl or aryl group, preferably $C_1$-$C_4$ alkyl, and more preferably a methyl group;

X is a linking group, preferably an alkylene group and more preferably —$(CH_2)_p$— or —$CH_2$—CH(OH)—$CH_2$—; wherein p is from 2 to 6, preferably 2 to 3;

Q is selected from the group consisting of —$NH_2$, —NH—$(CH_2)_2$—$NH_2$, —(O—$CHR_2$—$CH_2$)—Z, and mixtures thereof; wherein $R_2$ is H or $C_1$-$C_3$ alkyl, preferably H or $CH_3$; and Z is selected from the group consisting of —$OR_3$, —OC(O)$R_3$, —CO—$R_4$—CO—OH, —$SO_3$—, —PO$(OH)_2$, and mixtures thereof; further wherein $R_3$ is H, $C_1$-$C_{26}$ alkyl or substituted alkyl, $C_6$-$C_{26}$ aryl or substituted aryl, $C_7$-$C_{26}$ alkylaryl or substituted alkylaryl groups, preferably $R_3$ is H, methyl, ethyl propyl or benzyl groups; $R_4$ is —$CH_2$— or —$CH_2CH_2$— groups;

m is from 4 to 50,000, preferably from 10 to 20,000;

k is from 1 to 25,000, preferably from 3 to 12,000.

In typical embodiments, the organosilicones suitable for use herein have a viscosity ranging from about 10 to about 600,000 CSt at 25° C. In other embodiments, the suitable organosilicones have a viscosity from about 10 to about 100,000 CSt.

These organosilicones typically have the solubility in water of less than 10 g/L, preferably less than 1 g/L at 25° C. It is believed that if the solubility of the organosilicone is more than 1 g/L, it will remain soluble in the wash liquor and consequently will not deposit onto the fabrics.

One class of preferred organosilicones are those polyalkylene oxide polysiloxanes described below. Typically, the polyalkylene oxide polysiloxanes have a dimethyl polysiloxane hydrophobic moiety and one or more hydrophilic polyalkylene oxide chains. The hydrophilic polyakylene oxide chains can be incorporated as side chains (pendant moieties) or as block copolymer moieties with the polysiloxane hydrophobic moiety. Preferred, polyalkylene oxide polysiloxanes have hydrophilic polyalkylene oxide as pendant moieties and are represented by the following formula:

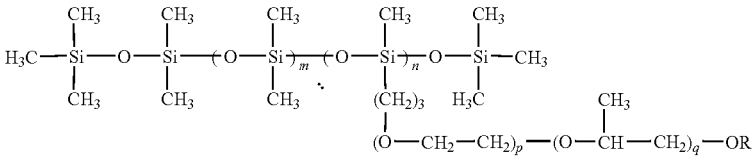

wherein R is H or $C_1$-$C_6$ alkyl, preferably H or $C_1$-$C_4$ alkyl; m is from 4 to 40,000; n is from 3 to 35,000; and p and q are integers independently selected from 2 to 30.

Polyalkylene oxide polysiloxanes suitable for use in the present invention have a HLB value less than about 7, preferably of about 2 to about 7. It is recognized that the HLB of the polymer will increase with an increasing amount of polyethylene oxide group in the polymer. Thus, suitable polyalkylene oxide polysiloxanes may have polyalkylene oxide content less than 70%, preferably less than 60% by weight of the polymer.

Suitable polyalkylene oxide polysiloxanes may comprise more than one type of alkoxy groups. More specifically, the higher the polyalkylene oxide content in the polysiloxanes, the more likely they contain more than one type of alkoxy groups.

Polyalkylene oxide polysiloxanes suitable for use in the present invention may have a viscosity of 10-100,000 cSt.

Nonlimiting examples of such polysiloxanes with polyalkylene oxide are Silwet® L-7622, Silwet® L-7602, Silwet® L-7604, Silwet® L-7500, Magnasoft® TLC, available from GE Silicones of Wilton, Conn.; Ultrasil® SW-12 and Ultrasil® DW-18 silicones, available from Noveon Inc., of Cleveland Ohio; and DC-5097, FF-400® available from Dow Corning® of Midland, Mich. Additional examples of polysiloxanes with polyalkylene oxide are KF-352®, KF-6015®, and KF-945®, all available from Shin Etsu Silicones of Tokyo, Japan.

Another class of preferred self-emulsifying silicone is modified polyalkylene oxide polysiloxanes of the general formula:

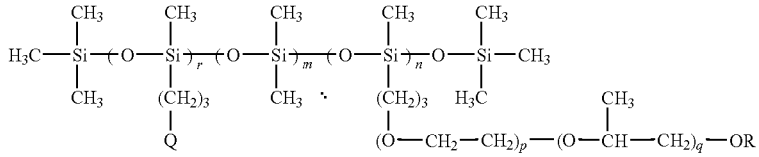

wherein Q is $NH_2$ or —$NHCH_2CH_2NH_2$; R is H or $C_1$-$C_6$ alkyl; r is from 1 to 1000; m is from 4 to 40,000; n is from 3 to 35,000; and p and q are integers independently selected from 2 to 30.

Nonlimiting examples of this class of organosilicones are Ultrasil® A21 and Ultrasil® A-23, both available from Noveon, Inc. of Cleveland, Ohio; BY16-876® from Dow Corning Toray Ltd., Japan; and X22-3939A® from Shin Etsu Corporation, Tokyo Japan.

A third class of preferred organosilicones is modified polyalkylene oxide polysiloxanes of the general formula:

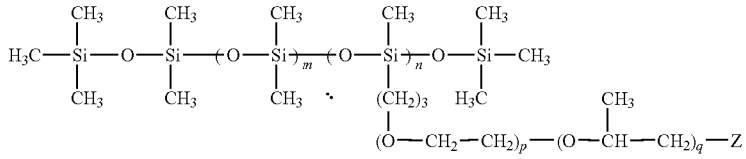

wherein Z is selected from i.

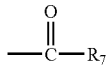

wherein $R_7$ is C1-C24 alkyl group;

ii.

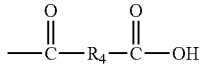

wherein $R_4$ is $CH_2$ or $CH_2CH_2$;

iii. —$SO_3$;

iv.

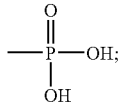

v.

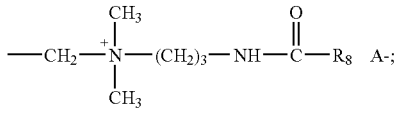

vi.

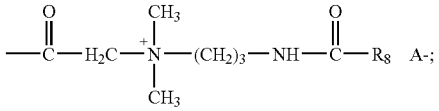

wherein $R_8$ is $C_1$ to $C_{22}$ alkyl and A is an appropriate anion, preferably $Cl^-$;

and wherein m is from 4 to 40,000; n is from 3 to 35,000; and p and q are integers independently selected from 2 to 30.

Examples of these silicones are Ultrasil® SW-12, Ultrasil® DW-18, Ultrasil® DW-AV, Ultrasil® Q-Plus, Ultrasil® Ca-1, Ultrasil® CA-2, Ultrasil® SA-1 and Ultrasil® PE-100 all available from Noveon Inc., Cleveland, Ohio. Additional nonlimiting examples include Pecosil® CA-20, Pecosil® SM-40, Pecosil® PAN-150 available from Phoenix Chemical Inc., of Somerville, N.J.

In other embodiments, mixtures of the above classes of polyalkylene oxide polysiloxanes are also preferred.

(ii) Emulsifiers

Emulsifiers useful in aiding the formation of organosilicone microemulsions in the composition of the present invention are anionic surfactants. Optionally, nonionic surfactants useful as laundry adjuncts to provide detersive benefits can also aid the formation and stability of the microemulsions. In a typical embodiment, the amount of emulsifiers is from about 0.05% to about 15% by weight of the composition.

Nonlimiting examples of anionic surfactants include the following: alkyl sulfonates, such as $C_{11}$-$C_{18}$ alkyl benzene sulfonates (LAS) or $C_{10}$-$C_{20}$ branched-chain and random alkyl sulfates (AS); $C_{10}$-$C_{18}$ alkyl ethoxy sulfates ($AE_xS$) wherein x is from 1-30; mid-chain branched alkyl sulfates (U.S. Pat. No. 6,020,303 and U.S. Pat. No. 6,060,443) or mid-chain branched alkyl alkoxy sulfates (U.S. Pat. No. 6,008,181 and U.S. Pat. No. 6,020,303); $C_{10}$-$C_{18}$ alkyl alkoxy carboxylates comprising 1-5 ethoxy units; modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; $C_{12}$-$C_{20}$ methyl ester sulfonate (MES); $C_{10}$-$C_{18}$ alpha-olefin sulfonate (AOS); and $C_6$-$C_{20}$ sulfosuccinates.

Preferred Laundry Adjuncts (a) Stabilizer—Compositions of the present invention may and preferably do include a stabilizer. Suitable levels of this component are in the range from about 0.01% to about 20%, more preferably from about 0.1% to about 10%, even more prefereably from about 0.1% to about 3% by weight of the composition. The stabilizer serves to stabilize the organosilicone in the inventive compositions and to prevent it from coagulating and/or creaming. This is especially important when the inventive compositions have fluid form, as in the case of liquid or gel-form laundry detergents for heavy-duty or fine fabric wash use, and liquid or gel-form fabric treatments for pre- or post washing uses.

Stabilizers suitable for use herein include a crystalline, hydroxyl-containing stabilizing agent, more preferably still, a trihydroxystearin, hydrogenated oil or a variation thereof.

In one embodiment, the process comprises activating the crystalline, hydroxyl-containing stabilizing agent such that a thread-like structure is prepared. Details around this process of making the thread-like structuring system can be found in U.S. Pat. No. 6,080,708, issued to The Procter and Gamble Company.

The crystalline, hydroxyl-containing stabilizing agent typically is present in the liquid compositions of the present invention at a level of from about 0.1% to about 10%, more typically from about 0.1% to about 3%, most typically from about 0.3% to about 2% by weight of the liquid composition.

In some embodiments, the crystalline, hydroxyl-containing stabilizing agents can be water-insoluble wax-like substances, including fatty acid, fatty ester or fatty soap. In other embodiments, the crystalline, hydroxyl-containing stabilizing agents can be derivatives of castor oil, especially hydrogenated castor oil derivatives, for example, castor wax. In still other embodiments, the crystalline, hydroxyl-containing agent typically is selected from the group consisting of:

i) $R^1OCH_2CH(OR^2)CH_2OR^3$ wherein $R^1$ is —C(O)$R^4$, $R^2$ is $R^1$ or H, $R^3$ is $R^1$ or H, and $R^4$ is independently $C_{10}$-$C_{22}$ alkyl or alkenyl comprising at least one hydroxyl group;

(ii)

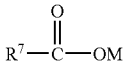

wherein:

$R^7$ is

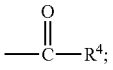

$R^4$ is as defined above in i); M is $Na^+$, $K^+$, $Mg^{++}$, $Al^{3+}$, or H; and iii) mixtures thereof.

Alternatively, the crystalline, hydroxyl-containing stabilizing agent may have the formula:

$$CH_3(CH_2)_aCHOH(CH_2)_xC(O)OCH_2CH(O(O)C(CH_2)_yCHOH(CH_2)_bCH_3)—CH_2O(O)C(CH_2)_zCHOH(CH_2)_cCH_3$$

wherein:

(x+a) is from 11 to 17; (y+b) is from 11 to 17; and (z+c) is from 11 to 17; preferably, wherein x=y=z=10 and/or wherein a=b=c=5.

Commercially available crystalline, hydroxyl-containing stabilizing agents include THIXCIN® from Rheox, Inc.

Stabilizers suitable for use herein can also be selected from thickening stabilizers, typically at levels of about 0.005% to about 3%, by weight. These include gums and other similar polysaccharides, for example gellan gum, carrageenan gum, and other known types of thickeners and rheological additives other than highly polyanionic types; thus conventional clays are not included. Exemplary stabilizers in this class include gum-type polymers (e.g. xanthan gum), polyvinyl alcohol and derivatives thereof, cellulose and derivatives thereof and tamarind gum (preferably consisting of xyloglucan polymers), guar gum, locust bean gum (preferably consisting of galactomannan polymers), and other industrial gums and polymers, which include, but are not limited to, Tara, Fenugreek, Aloe, Chia, Flaxseed, Psyllium seed, quince seed, xanthan, gellan, welan, rhamsan, dextran, curdlan, pullulan, scleroglucan, schizophyllan, chitin, hydroxyalkyl cellulose, arabinan (preferably from sugar beets), de-branched arabinan (preferably from sugar beets), arabinoxylan (preferably from rye and wheat flour), galactan (preferably from lupin and potatoes), pectic galactan (preferably from potatoes), galactomannan (preferably from carob, and including both low and high viscosities), glucomannan, lichenan (preferably from icelandic moss), mannan (preferably from ivory nuts), pachyman, rhamnogalacturonan, acacia gum, agar, alginates, carrageenan, chitosan, clavan, hyaluronic acid, heparin, inulin, cellodextrins, carboxymethylcellulose (CMC), dextrans, dextrins, ethylhydroxyethylcellulose (EHEC), guar, hydroxyethylcellulose (HEC), hydroxypropylcellulose (HPC), hydroxybutylcellulose (HBC), karaya, larch, methylcellulose (MC), tamarind, scleroglucan, xanthan, carboxymethylhydroxyethylcellulose (CMHEC), methoxypropyl methyl cellulose (MPMC), hexylcarboxymethyl cellulose, $C_{12}$-$C_{20}$ alkyl carboxymethylcellulose, methylhydroxyethylcellulose (MHEC), methylhydroxypropylcellulose (MHPC), hydroxyethylmethylcellulose (HEMC), hydroxypropylmethylcellulose (HPMC), hydroxybutylmethylcellulose (HBMC) and mixtures thereof.

(b) Nitrogen-free nonionic surfactant—The present compositions may and preferably do include preferred embodiments incorporating this type of detersive surfactant. Suitable levels of this component are in the range from about 0.01% to about 80%, more typically from about 0.1% to about 50%, preferably from about 1% to about 30% by weight of the composition.

Suitable surfactants of this type can be prepared from alkoxylates, including ethylene oxide, propylene oxide, butylene oxide and mixed alkylene oxide condensates of any suitable detergent alcohols having linear of branched hydrocarbyl moieties. Exemplary nonionic surfactants of this type include the following:

1) $C_9$-$C_{18}$ alkyl ethoxylates, such as, NEODOL® nonionic surfactants from Shell;
2) $C_6$-$C_{12}$ alkyl phenol alkoxylates wherein the alkoxylate units are a mixture of ethyleneoxy and propyleneoxy units;
3) $C_{12}$-$C_{18}$ alcohol and $C_6$-$C_{12}$ alkyl phenol condensates with ethylene oxide/propylene oxide block polymers such as Pluronic® from BASF;
4) $C_{14}$-$C_{22}$ mid-chain branched alcohols, BA, as discussed in U.S. Pat. No. 6,150,322;
5) $C_{14}$-$C_{22}$ mid-chain branched alkyl alkoxylates, BAEX, wherein x 1-30, as discussed in U.S. Pat. Nos. 6,153,577, 6,020,303 and 6,093,856;
6) Alkylpolysaccharides as discussed in U.S. Pat. No. 4,565,647 Llenado, issued Jan. 26, 1986; specifically alkylpolyglycosides as discussed in U.S. Pat. Nos. 4,483,780 and 4,483,779;

7) ether capped poly(oxyalkylated) alcohol surfactants as discussed in U.S. Pat. No. 6,482,994, WO 01/42408, and WO 01/42408; and 8) fatty acid ($C_{12-18}$) sorbitan esters, Span®, and their ethoxylated ($EO_{5-100}$) derivatives, polysorbates; such as Span®20, Tween® 20, Tween® 60, Tween® 80 (commercially available from Uniqema).

Other examples of ethoxylated surfactant include carboxylated alcohol ethoxylates.

Other nonionic surfactants for use herein include, but are not limited to: polyhydroxy fatty acid amides as discussed in U.S. Pat. No. 5,332,528, WO 92/06162, WO 93/19146, WO 93/19038, and WO 94/09099; alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside having a hydrophilic group containing from about 1.3 to about 10 polysaccharaide units. Any reducing saccharide containing 5 or 6 carbon atoms can be used. Optionally the hydrophobic group is attached at the 2-, 3-, 4-, etc. positions thus giving a glucose or galactose as opposed to a glucoside or galactoside. The intersaccharide bonds can be, e.g., between the one position of the additional saccharide units and the 2-, 3-, 4-, and/or 6-positions on the preceding saccharide units. Preferred alkylpolyglycosides have the formula $RO(C_nH_{2n}O)t(glycosyl)x$ wherein R is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7, and the glycosyl is preferably derived from glucose.

(c) Nitrogen-containing detersive surfactant—Suitable levels of this component, when present, are in the range from about 0.01% to about 20%, more preferably from about 0.1% to about 15%, typically from about 1% to about 10% by weight of the composition.The nitrogen-containing detersive surfactant herein is preferably selected from cationic nitrogen-containing detersive surfactants, amine oxide surfactants, amine and amide-functional detersive surfactants (including fatty amidoalkylamines) and mixtures thereof. Ethoxylated quaternary ammonium and etyhoxylated alkyl amine surfactants may also be used herein. The nitrogen-containing detersive surfactant is typically water-soluble and does not include silicone surfactants. Different surfactants of this type can be combined in varying proportions.

i) Cationic nitrogen containing detersive surfactants—Cationic nitrogen-containing detersive surfactants suitable for use in the compositions of the present invention are typically water-soluble and have at least one quatemized nitrogen and one long-chain hydrocarbyl group. Examples of such cationic surfactants include the water-soluble alkyltrimethylammonium salts or their hydroxyalkyl substituted analogs, preferably compounds having the formula $R_1R_2R_3R_4N^+X^-$ wherein $R_1$ is $C_8$-$C_{16}$ alkyl, each of $R_2$, $R_3$ and $R_4$ is independently $C_1$-$C_4$ alkyl, $C_1$-$C_4$ hydroxy alkyl, benzyl, and —$(C_2H_4O)xH$ where x has a value from 2 to 5, and X is an anion. Not more than one of $R_2$, $R_3$ or $R_4$ should be benzyl. The preferred alkyl chain length for $R_1$ is $C_{12}$-$C_{15}$. Preferred groups for $R_2$, $R_3$ and $R_4$ are methyl and hydroxyethyl and the anion X may be selected from halide, methosulfate, acetate and phosphate.

ii) Amine Oxide Surfactants—These surfactants have the formula: $R(EO)_x(PO)_y(BO)_zN(O)(CH_2R')_2.qH_2O$ (I). R is a relatively long-chain hydrocarbyl moiety which can be saturated or unsaturated, linear or branched, and can contain from about 8 to about 20, preferably from about 10 to about 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

iii) Amine and Amide Functional Detersive Surfactants—A preferred group of these surfactants comprises the amine surfactants, preferably an amine surfactant having the formula $RX(CH_2)_xNR^2R^3$ wherein R is $C_{6-12}$ alkyl; X is a bridging group which is selected from NH, CONH, COO, or O or X can be absent; x is from 2 to 4; $R_2$ and $R_3$ are each independently selected from H, $C_{1-4}$ alkyl, or ($CH_2$—$CH_2$—$O(R_4)$) wherein $R_4$ is H or methyl. Particularly preferred surfactants of this type include those selected from the group consisting of decyl amine, dodecyl amine, $C_{8-12}$ bis(hydroxyethyl)amine, $C_{8-12}$ bis(hydroxypropyl)amine, $C_{8-12}$ amido propyl dimethyl amine, and mixtures thereof.

This group of surfactants also includes fatty acid amide surfactants having the formula $RC(O)NR'_2$ wherein R is an alkyl group containing from about 10 to about 20 carbon atoms and each R' is a short-chain moiety preferably selected from the group consisting of hydrogen and $C_{1-4}$ alkyl and hydroxyalkyl. The $C_{10-18}$ N-alkyl polyhydroxy fatty acid amides can also be used. Typical examples include the $C_{12-18}$ N-methylglucamides. See WO 92/06154. Other sugar-derived nitrogen-containing nonionic surfactants include the N-alkoxy polyhydroxy fatty acid amides, such as $C_{10-18}$ N-(3-methoxypropyl) glucamide.

(d) Coupling agent—Coupling agents suitable for use herein include fatty amines other than those which have marked surfactant character or are conventional solvents (such as the lower alkanolamines). Examples of these coupling agents include hexylamine, octylamine, nonylamine and their C1-C3 secondary and tertiary analogs. Levels of this component, when present, are suitably in the range of from about 0.1% to about 20%, more typically about 0.5% to about 5% by weight of the composition.

A particularly useful group of coupling agents is selected from the group consisting of molecules which consist of two polar groups separated from each other by at least 5, preferably 6, aliphatic carbon atoms; preferred compounds in this group are free from nitrogen and include: 1,4 Cyclo Hexane Di Methanol (CHDM), 1,6 Hexanediol, 1,7 Heptanediol and mixtures thereof; 1,4 Cyclo Hexane Di Methanol may be present in either its cis configuration, its trans configuration or a mixture of both configurations.

(e) Perfume—Perfumes are preferably incorporated into the fabric care compositions of the present invention. The perfume ingredients may be premixed to form a perfume accord prior to adding to the fabric care compositions of the present invention. As used herein, the term "perfume" encompasses individual perfume ingredients as well as perfume accords.

The level of perfume accord in the fabric care composition is typically from about 0.0001% to about 2% or higher, e.g., to about 10%; preferably from about 0.0002% to about 0.8%, more preferably from about 0.003% to about 0.6%, most preferably from about 0.005% to about 0.5% by weight of the fabric care composition.

The level of perfume ingredients in the perfume accord is typically from about 0.0001% (more preferably 0.01%) to about 99%, preferably from about 0.01% to about 50%, more preferably from about 0.2% to about 30%, even more preferably from about 1% to about 20%, most preferably from about 2% to about 10% by weight of the perfume accord.

The fabric care compositions of the present invention can comprise perfumes or perfume accords to provide a "scent signal" in the form of a pleasant odor which provides a freshness impression to the washed fabrics. The perfume ingredients are suitably at levels in the range from about 0.0001% to about 10% by weight of the fabric care composition and are characterized by their boiling points (B.P.). The perfume ingredients have a B.P, measured at the normal, standard pressure of 760 mm Hg, of about 240° C. or higher, and preferably of about 250° C. or higher. Preferably the perfume ingredients have a ClogP of greater than 3, more preferably from about 3 to about 6.

In some embodiments, the perfume accords used in the fabric care composition of the present invention contain at least 2 different perfume ingredients. In other embodiments, the perfume accords used in the fabric care composition of the present invention contain from at least 3 to at least 7 different perfume ingredients. Most common perfume ingredients which are derived from natural sources are composed of a multitude of components. When each such material is used formulating the perfume accords of the present invention, it is counted as one single ingredient, for the purpose of defining the invention.

Any type of perfume can be incorporated into the composition of the present invention. The preferred perfume ingredients are those suitable for use to apply on fabrics and garments. Typical examples of such preferred ingredients are given in U.S. Pat. No. 5,445,747.

When long lasting fragrance odor on fabrics is desired, it is preferred to use at least an effective amount of perfume ingredients which have a boiling point of about 300° C. or higher. Nonlimiting examples of such preferred ingredients are given in U.S. Pat. No. 5,500,138, issued Mar. 19, 1996 to Bacon et al., incorporated herein by reference. It is also preferred to use materials that can slowly release perfume ingredients after the fabric is treated by the wrinkle control composition of this invention. Examples of materials of this type are given in U.S. Pat. No. 5,531,910, Severns et al., issued Jul. 2, 1996.

When cyclodextrin is present, it is essential that the perfume be added at a level wherein even if all of the perfume in the composition were to complex with the cyclodextrin molecules when cyclodextrin is present, there will still be an effective level of uncomplexed cyclodextrin molecules present in the solution to provide adequate odor control. In order to reserve an effective amount of cyclodextrin molecules for odor control when cyclodextrin is present, perfume is typically present at a level wherein less than about 90% preferably less than about 50%, more preferably, less than about 30%, and most preferably, less than about 10% of the cyclodextrin complexes with the perfume. The cyclodextrin to perfume weight ratio should be greater than about 5:1 preferably greater than about 8:1, more preferably greater than about 10:1, even more preferably greater than about 20:1, still more preferably greater than 40:1 and most preferably greater than about 70:1.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1. Exemplary perfume ingredient of the above groups (a) and (b) are disclosed in U.S. Pat. No. 6,491,840.

Additionally, fabric substantive perfumes such as those disclosed in and U.S. Pat. No. 6,903,061 are also useful herein.

(f) Scavenger agent—The compositions of the present invention may comprise at least about 0.001%, preferably from about 0.5% to about 10%, most preferably to about 5% by weight, of one or more scavenger agents. Scavenger agents suitable for use herein are selected from scavengers selected to capture fugitive dyes and/or anionic surfactants and/or soils.

Preferred scavenger agents are selected from the group consisting of fixing agents for anionic dyes, complexing agents for anionic surfactants, clay soil control agents and mixtures thereof. These materials can be combined at any suitable ratio. Suitable compounds are disclosed in commonly-owned patents to Gosselink et al and are commercially available from BASF, Ciba and others.

i) Fixing Agents for Anionic dyes—Dye fixing agents, "fixatives", or "fixing agents" are well-known, commercially available materials which are designed to improve the appearance of dyed fabrics by minimizing the loss of dye from fabrics due to washing. Not included within this definition are components which can in some embodiments serve as fabric softener actives.

Many fixing agents for anionic dyes are cationic, and are based on quatemized nitrogen compounds or on nitrogen compounds having a strong cationic charge which is formed in situ under the conditions of usage.

Fixing agents are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneimine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy and described in WO 99/14301. Other preferred fixing agents for use in the compositions of the present invention are CARTAFIX CB® ex Clariant and the cyclic amine based polymers, oligomers or copolymers described in WO 99/14300.

Other fixing agents useful herein are described in "Aftertreatments for Improving the Fastness of Dyes on Textile Fibres", Christopher C. Cook, Rev. *Prog. Coloration*, Vol. XII, (1982). Dye fixing agents suitable for use in the present invention are ammonium compounds such as fatty acid-diamine condensates, inter alia the hydrochloride, acetate, methosulphate and benzyl hydrochloride salts of diamine esters. Non-limiting examples include oleyldiethyl aminoethylamide, oleylmethyl diethylenediamine methosulphate, and monostearylethylene diaminotrimethylammonium methosulphate. In addition, N-oxides other than surfactant-active N-oxides, more particularly polymeric N-oxides such as polyvinylpyridine N-oxide, are useful as fixing agents herein. Other useful fixing agents include derivatives of polymeric alkyldiamines, polyamine-cyanuric chloride condensates, and aminated glycerol dichlorohydrins.

Fixing agents for anionic dyes can be used in the present methods either in the form of such agents fully integrated into the inventive compositions, or by including them in a laundry treatment method according to the invention in the form of a separate article, for example a substrate article or sheet, which can be added to the wash along with the organosilicone containing composition. In this manner, the fixing agent can complement the use of the organosilicone composition. Combinations of such dye fixing articles and compositions comprising the organosilicones can be sold together in the form of a kit.

ii) Scavenger agents for anionic surfactants and/or soils—Suitable scavenger agents for anionic surfactants and/or soils include alkoxylated polyalkyleneimines and/or quatemized derivatives thereof.

(g) Fabric softeners—Fabric softeners, when present in the preferred compositions of the invention, are suitably at levels of up to about 30% by weight of the composition, more typically from about 1% to about 20%, preferably from about 2% to about 10% in certain embodiments. Suitable fabric softeners for use in the present invention include all the current commercial quaternary long-chain softeners, especially at least partially unsaturated esterquats with varying iodine value. Suitable fabric softeners more generally include fabric softening compounds which are cationic, water insoluble quaternary ammonium compounds comprising a polar head group and two long hydrocarbyl moieties, preferably selected from alkyl, alkenyl and mixtures thereof, wherein each such hydrocarbyl moiety has an average chain length equal to or greater than $C_{12}$, preferably greater than $C_{14}$, more preferably greater than $C_{16}$, More preferably still, at least 50% of each long chain alkyl or alkenyl group is predominantly linear. A preferred overall chain length is about $C_{18}$, though mixtures of chain-lengths having non-zero proportions of lower, e.g., $C_{14}$, $C_{16}$ and some higher, e.g., $C_{20}$ chains can be quite desirable. The cationic softener can suitably be distearyl dimethyl ammonium chloride or unsaturated analogs thereof, but more preferably for the environment, the quaternary ammonium fabric softener is selected to be biodegradable. This property is present, for example, in the common commercial esterquat fabric softeners such as di(tallowyloxyethyl)dimethyl ammonium chloride.

In one preferred embodiment, the fabric softening compound is a quaternary ammonium esterquat compound having two $C_{12-22}$ alkyl or alkenyl groups connected to a quaternary ammonium moiety via at least one ester moiety, preferably two such ester moieties. A preferred esterquat ammonium fabric softener for use in the present compositions has the formula:

$\{(R^1)_2N((CH_2)_nER^2)_2\}^+X^-$ wherein each $R^1$ group is independently selected from $C_{1-4}$ alkyl, hydroxyalkyl or $C_{2-4}$ alkenyl; and wherein each $R^2$ is independently selected from $C_{8-28}$ alkyl or alkenyl groups; E is an ester moiety i.e., —OC(O)— or —C(O)O—, n is from 0-5, and $X^-$ is a suitable anion, for example chloride, methosulfate and mixtures thereof.

A second preferred type of quaternary ammonium material can be represented by the formula: $\{(R^1)_3N(CH_2)_nCH(O(O)CR^2)CH_2O(O)CR^2\}^+X^-$ wherein each $R^1$ group is independently selected from $C_{1-4}$ alkyl, hydroxyalkyl or $C_{2-4}$ alkenyl; each $R^2$ is independently selected from $C_{8-28}$ alkyl or alkenyl groups; n is from 0-5; and $X^-$ is a suitable anion, for example chloride, methosulfate and mixtures thereof. This latter class can be exemplified by 1,2 bis[hardened tallowoyloxy]-3-trimethylammonium propane chloride.

Esterquat fabric softeners as available in commerce include materials comprising varying proportions of monoester in addition to diester.

Suitable fabric softeners herein include softening compounds having a solubility less than $1\times10^{-3}$ wt %, more preferably less than $1\times10^{-4}$ wt %, more preferably still, from $1\times10^{-6}$ wt % to $1\times10^{-8}$ wt %, in demineralised water at 20 degrees C.

(h) Detersive enzymes—Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

(i) Bleach system—Bleach systems suitable for use herein contain one or more bleaching agents. Nonlimiting examples of suitable bleaching agents are selected from the group consisting of catalytic metal complexes, activated peroxygen sources, bleach activators, bleach boosters, photobleaches, bleaching enzymes, free radical initiators, $H_2O_2$, and hypohalite bleaches.

Examples of suitable catalytic metal complexes include, but are not limited to, manganese-based catalysts such as those disclosed in U.S. Pat. No. 5,576,282; cobalt based catalysts such as those disclosed in U.S. Pat. No. 5,597,936; and transition metal complexes of a macropolycyclic rigid ligand—abbreviated as "MRL", such as those disclosed in WO 00/332601, and U.S. Pat. No. 6,225,464. Non-limiting examples of suitable metals in the MRLs include Mn, Fe, Co, Ni, Cu, Cr, V, Mo, W, Pd, and Ru in their various oxidation states. Non-limiting examples of suitable MRLs include dichloro-5,12-diethyl-1,5,8,12-tetraazabicyclo[6.6.2]hexadecane manganese(II), dichloro-5,12-diethyl-1,5,8,12-tetraazabicyclo[6.6.2]hexadecane manganese(III) hexafluorophosphate and dichloro-5-n-butyl-12-methyl-1,5,8,12-tetraazabicyclo[6.6.2]hexadecane manganese(II).

Suitable activated peroxygen sources include, but are not limited to, preformed peracids, a hydrogen peroxide source in combination with a bleach activator, or a mixture thereof. Suitable preformed peracids include, but are not limited to, compounds selected from the group consisting of percarboxylic acids and salts, percarbonic acids and salts, perimidic acids and salts, peroxymonosulfuric acids and salts, and mixtures thereof. Suitable sources of hydrogen peroxide include, but are not limited to, compounds selected from the group consisting of perborate compounds, percarbonate compounds, perphosphate compounds and mixtures thereof. Suitable types and levels of activated peroxygen sources are found in U.S. Pat. Nos. 5,576,282, 6,306,812 and 6,326,348. Suitable bleach activators include, but are not limited to, perhydrolyzable esters and perhydrolyzable imides such as, tetraacetyl ethylene diamine, octanoylcaprolactam, benzoyloxybenzenesulphonate, nonanoyloxybenzenesulphonate, benzoylvalerolactam, dodecanoyloxybenzenesulphonate.

Suitable bleach boosters include, but are not limited to, those described U.S. Pat. No. 5,817,614.

(j) Chelant—Suitable water-soluble chelants for use herein include citrates as well as nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems. Levels of chelant are typically lower than about 5%, more typically, chelants, when present, are at levels of from about 0.01% to about 3%.

(k) Solvent system—The solvent system in the present compositions can be a solvent system containing water alone or mixtures of organic solvents with water. Preferred organic solvents include 1,2-propanediol, ethanol, glycerol and mixtures thereof. Other lower alcohols, $C_1$-$C_4$ alkanolamines such as monoethanolamine and triethanolamine, can also be used. Solvent systems can be absent, for example from anhydrous solid embodiments of the invention, but more typically are present at levels in the range of from about 0.1% to about 98%, preferably at least about 10% to about 95%, more usually from about 25% to about 75%.

(l) Effervescent system—Effervescent systems suitable herein include those derived by or any other combination of materials which release small bubbles of gas. The components of the effervescent system may be combinedly dispensable to form the effervescence when they are mixed, or can be formulated together provided that conventional coatings or protection systems are used. Levels of effervescent system can vary very widely, for example effervescent components together can range from about 0.1% to about 30% of the composition. Hydrogen peroxide and catalase are very mass efficient and can be at much lower levels with excellent results.

(m) Mixtures of adjuncts—Mixtures of the above components can be made in any proportion.

(n) Other adjuncts—Examples of other suitable cleaning adjunct materials include, but are not limited to, fatty acids; alkoxylated benzoic acids or salts thereof such as trimethoxy benzoic acid or a salt thereof (TMBA); zwitterionic and/or amphoteric surfactants; enzyme stabilizing systems; inorganic builders including inorganic builders such as zeolites and water-soluble organic builders such as polyacrylates, acrylate/maleate copolymers and the like; coating or encapsulating agent including polyvinylalcohol film or other suitable variations, carboxymethylcellulose, cellulose derivatives, starch, modified starch, sugars, PEG, waxes, or combinations thereof; optical brighteners or fluorescers; soil release polymers; dispersants; suds suppressors; dyes; colorants; filler salts such as sodium sulfate; hydrotropes such as toluenesulfonates, cumenesulfonates and naphthalenesulfonates; photoactivators; hydrolyzable surfactants; preservatives; anti-oxidants; anti-shrinkage agents; anti-wrinkle agents; germicides; fungicides; color speckles; colored beads, spheres or extrudates; sunscreens; fluorinated compounds; clays; pearlescent agents; luminescent agents or chemiluminescent agents; anti-corrosion and/or appliance protectant agents; alkalinity sources or other pH adjusting agents; solubilizing agents; processing aids; pigments; free radical scavengers, and mixtures thereof. Suitable materials include those described in U.S. Pat. Nos. 5,705,464, 5,710,115, 5,698,504, 5,695,679, 5,686,014 and 5,646,101.

Incorporation of Organosilicones Into Compositions of the Invention

Incorporation of organosilicones into compositions of the invention can be done in any suitable manner and can, in general, involve any order of mixing or addition. However, it has been discovered that there exist certain preferred ways to accomplish such incorporation.

A first method involves introducing the organosilicones as received from the manufacturer directly into a preformed mixture of two or more of the other components of the final composition. This can be done at any point in the process of preparing the final composition, including at the very end of the formulating process. That is, the organosilicones can be added to a pre-made liquid laundry detergent to form the final composition of the present invention.

A second method involves premixing the organosilicone polymer with an emulsifier and water to prepare the organosilicone microemulsion, which is then mixed with other components of the final composition. These components can be added in any order and at any point in the process of preparing the final composition.

A third method involves mixing the organosilicone polymer with one or more adjuncts of the final composition and adding this premix to a mixture of the remaining adjuncts.

These methods of introducing the organosilicone polymer or microemulsion into the final composition are preferably assisted by use of conventional high-shear mixing means. This ensures proper dispersion of the organosilicone polymer throughout the final composition.

Liquid compositions, especially liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition. When such a stabilizer premix is used, it is preferably added into the composition after the organosilicone polymer has already been introduced and dispersed in the composition.

EXAMPLES

The following nonlimiting examples are illustrative of the present invention. Percentages are by weight unless otherwise specified.

| Ingredient | Wt % |
|---|---|
| C12-15alkyl polyethoxylate (1.8) sulfate | 18.0 |
| Ethanol | 2.5 |
| Diethylene glycol | 1.3 |
| Propandiol | 3.5 |
| C12-13Alkyl polyethoxylate (9) | 0.4 |
| C12-14 fatty acid | 2.5 |
| Sodium cumene sulfonate | 3.0 |
| Citric acid | 2.0 |
| Sodium hydroxide (to pH 8.0) | 1.5 |
| Protease (32 g/L) | 0.3 |
| Self Emulsifying Silicone from Table 1 | 2.0 |
| Soil suspending polymers | 1.1 |
| Water, perfume, enzymes, suds suppressor, brightener, enzyme stabilizers & other optional ingredients | to 100% |

TABLE 1

| Example | Self-emulsifying Silicone | Supplied by |
|---|---|---|
| 1 | Dow Corning BY 16-878 ® | Dow Corning Corporation, Midland MI |
| 2 | Ultrasil ® A-21 | Noveon Inc., Cleveland, OH |
| 3 | Utltasil ® A-23 | Noveon Inc., Cleveland, OH |
| 4 | X22-3939A ® | Shin-Etsu Corporation, Tokyo, Japan |
| 5 | Silwet ® L7622 | GE Silicones, Greenwich CT |
| 6 | Silwet ® L7500 | GE Silicones, Greenwich CT |
| 7 | Magnasoft TLC ® | GE Silicones, Greenwich CT |
| 8 | Ultrasil ® SA-1 | Noveon Inc. Cleveland, OH |
| 9 | Ultrasil ® CA-1 | Noveon Inc. Cleveland, OH |
| 10 | Ultrasil ® CA-2 | Noveon Inc. Cleveland, OH |
| 11 | Silwet ® L-7602 | GE Silicones, Greenwich CT |
| 12 | Silsoft ® A-858 | GE Silicones, Greenwich CT |
| 13 | Pecosil ® PS 150 | Phoenix Chemicals, Somemrville, NJ |
| 14 | Pecosil ® PAN 150 | Phoenix Chemicals, Somemrville, NJ |

Product with Instructions for Use

The compositions of the present invention are preferably included in a product. The product preferably comprises a fabric care composition in accordance with the present invention, and further comprises instructions for using the product to launder fabrics by contacting a fabric in need of treatment with an effective amount of the composition such that the composition imparts one or more desired fabric care benefits to the fabric.

The present invention therefore also encompasses the inclusion of instructions on the use of the fabric care compositions of the present invention with packages containing the compositions herein or with other forms of advertising associated with the sale or use of the compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase or use of the compositions.

Specifically the instructions will include a description of the use of the composition, for instance, the recommended amount of composition to use in a washing machine to clean the fabric; the recommended amount of composition to apply to the fabric; if soaking or rubbing is appropriate.

Service Business Use

Any of the above systems, compositions and methods can be used in a laundry service business, for example in a dry-cleaning establishment, an institutional laundry (such as school, hotel or military field laundry) or similar, without departing from the spirit and scope of the invention.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition for fabric cleaning and fabric care comprising:

(a) an organosilicone having the formula:

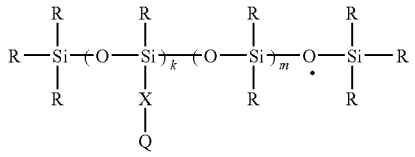

wherein each R is a $C_1$-$C_8$ alkyl or aryl group

X is a linking group;

Q is selected from the group consisting of —$NH_2$, —NH—$(CH_2)_2$—$NH_2$, —(O—$CHR_2$—$CH_2$)—Z, and mixtures thereof, wherein $R_2$ is H or $C_1$-$C_3$ alkyl, and Z is selected from the group consisting of —$OR_3$, —OC(O)$R_3$, —CO—$R_4$—CO—OH, —$SO_3$, —PO$(OH)_2$, and mixtures thereof, further wherein $R_3$ is H, $C_1$-$C_{26}$ alkyl or substituted alkyl, $C_6$-$C_{26}$ aryl or substituted aryl, $C_7$-$C_{26}$ alkylaryl or substituted alkylaryl groups $R_4$ is —$CH_2$— or —$CH_2CH_2$— groups;

m is from 4 to 50,000; and k is from 1 to 25,000;

(b) an emulsifier comprising anionic surfactant;

(c) other laundry adjunct materials; and (d) a carrier comprising water;

wherein the organosilicone is in the form of aqueous microemulsion having an average particle size less than about 100 nm; the detergent composition has a viscosity of from about 1 to about 2000 mPa*s; and the organosilicone has a HLB value of about 2 to about 7;

and further wherein the composition comprises a detersive enzyme and a nitrogen-containing detersive surfactant selected from the group consisting of an amine oxide surfactant, an amine-functional detersive surfactant, and combinations thereof.

2. The composition according to claim 1 wherein the organosilicone has the formula:

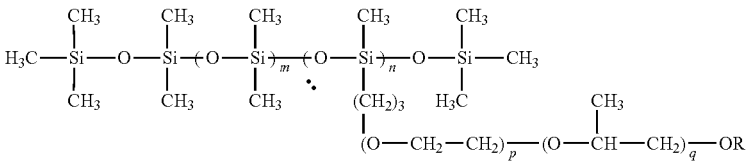

wherein R is H or $C_1$-$C_6$ alkyl; m is from 4 to 40,000; n is from 3 to 35,000; and p and q are integers independently selected from 2 to 30.

3. The composition according to claim 1 wherein the organosilicone has the formula:

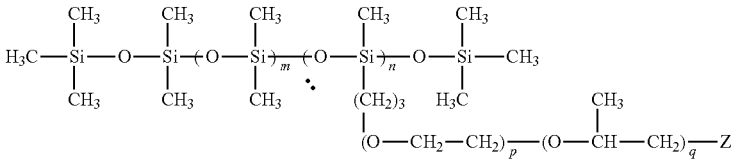

wherein Z is selected from i.

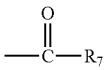

wherein $R_7$ is C1-C24 alkyl group;

ii.

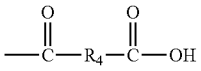

wherein $R_4$ $CH_2$ or $CH_2CH_2$;

iii. —$SO_3$;

and wherein m is from 4 to 40,000; n is from 3 to 35,000; and p and q are integers independently selected from 2 to 30.

4. The composition according to claim 1 wherein the anionic surfactant is selected from the group consisting of $C_{11}$-$C_{18}$ alkyl benzene sulfonates (LAS), $C_{10}$-$C_{20}$ branched-chain and random alkyl sulfates (AS), $C_{10}$-$C_{18}$ alkyl ethoxy sulfates ($AE_xS$) wherein x is from 1-30, mid-chain branched alkyl sulfates, mid-chain branched alkyl alkoxy sulfates, $C_{10}$-$C_{18}$ alkyl alkoxy carboxylates comprising 1-5 ethoxy units, modified alkylbenzene sulfonate (MLAS), $C_{12}$-$C_{20}$ methyl ester sulfonate (MES), $C_{10}$- $C_{18}$ alpha-olefin sulfonate (AOS), $C_6$-$C_{20}$ sulfosuccinates, and mixtures thereof.

5. The composition according to claim 4 wherein the emulsifier further comprises a nonionic surfactant selected from the group consisting of $C_9$-$C_{18}$ alkyl ethoxylates, $C_6$-$C_{12}$ alkyl phenol alkoxylates, $C_{12}$-$C_{18}$ alcohol and $C_6$-$C_{12}$ alkyl phenol condensates with ethylene oxide/propylene oxide block polymers, $C_{14}$-$C_{22}$ mid-chain branched alcohols, $C_{14}$-$C_{22}$ mid-chain branched alkyl alkoxylates, alkylpolyglycosides, polyhydroxy fatty acid amides, ether capped poly(oxyalkylated) alcohols, fatty acid ($C_{12-18}$) sorbitan esters, and mixtures thereof.

6. The composition according to claim 4 wherein the anionic surfactant is selected from the group consisting of $C_{11}$-$C_{18}$ alkyl benzene sulfonates (LAS), $C_{10}$-$C_{18}$ alkyl ethoxy sulfates ($AE_xS$) wherein x is from 1-30, and mixtures thereof.

7. The composition according to claim 1 wherein the laundry adjunct material is selected from the group consisting of: a stabilizer; a nitrogen-free nonionic surfactant; a coupling agent; a perfume; a scavenger agent; a fabric softener; a bleach system; a chelant; a solvent system; an effervescent system; and mixtures thereof.

8. The composition according to claim 1 comprising:

from about 0.01 to about 10% by weight of the composition of organosilicone;

from about 0.05 to about 15% by weight of the composition of anionic surfactant;

from about 0.0001 to about 20% by weight of the composition of one or more laundry adjunct material; and the balance of water;

wherein the organosilicone is emulsified to an average particle size of from about 1 nm to less than about 100 nm, and the composition has a viscosity of from about 1 to about 500 mPa*s and is transparent.

9. The composition according to claim 8 wherein the laundry adjuncts are selected from the group consisting of stabilizers, nonionic surfactants, nitrogen-containing surfactants, bleaches, enzymes, perfumes, scavenger agents, and mixtures thereof.

10. A method for treating a substrate in need of treatment comprising contacting the substrate with a fabric care composition according to claim 1 such that the substrate is treated.

11. A method for treating a substrate in need of treatment comprising contacting the substrate with a fabric care composition according to claim 8 such that the substrate is treated.

12. A treated substrate made by contracting the substrate with the composition of claim 1.

13. A treated substrate made by contacting the substrate with the composition of claim 8.

14. A method for producing the composition according to claim 1, the composition containing organosilicone microemulsions comprising the steps of:

a) premixing an organosilicone, an emulsifier and water to produce a microemulsion premix;

mixing the premix from a) with one or more cleaning adjunct materials comprising detersive enzyme and nitrogen-containing detersive surfactant selected from the group consisting of amine oxide surfactant, amine-functional detersive surfactant, and combinations thereof.

* * * * *